United States Patent [19]

Davidson

[11] 4,337,603

[45] Jul. 6, 1982

[54] BUSHING, FORMED COMPRESSIBLE INSULATION FOR INSULATING AIR SPACE CREATED BY HOLES

[76] Inventor: James D. Davidson, 67 Grantour Ct., Pontiac, Mich. 48055

[21] Appl. No.: 50,825

[22] Filed: Jun. 21, 1979

[51] Int. Cl.[3] ..... E04B 5/48; E04F 17/08

[52] U.S. Cl. ..... 52/220; 16/2; 52/221; 138/156; 248/56; 285/47; 285/192

[58] Field of Search ..... 52/220, 221, 101, 406, 52/407; 248/56; 16/2; 285/47, 192; 138/156

[56] References Cited

U.S. PATENT DOCUMENTS

| | | | |
|---|---|---|---|
| 2,160,009 | 5/1939 | Walker | 285/47 X |
| 3,191,632 | 6/1965 | Keiding | 138/156 X |
| 3,816,610 | 6/1974 | Lusby | 52/101 |
| 3,918,667 | 11/1975 | Madden | 16/2 X |
| 3,973,789 | 8/1976 | Kunz | 285/47 X |
| 4,086,736 | 5/1978 | Landrigan | 52/221 |
| 4,180,297 | 12/1979 | Abrams | 16/2 X |

FOREIGN PATENT DOCUMENTS

| | | | |
|---|---|---|---|
| 175849 | 8/1953 | Austria | 52/220 |
| 767341 | 5/1952 | Fed. Rep. of Germany | 52/220 |
| 2551693 | 6/1977 | Fed. Rep. of Germany | 52/221 |
| 488547 | 7/1938 | United Kingdom | 138/156 |

*Primary Examiner*—Alfred C. Perham

[57] ABSTRACT

A bushing formed of insulation that can be installed in holes drilled in wood framing components, used to construct a building, such as a dwelling, these holes are drilled so plumbing pipes & electrical wiring can be installed in said framing components.

Purpose of this invention is to close off & insulate these holes before the articles are installed, or after they are installed, either method would greatly reduce infiltration & heat transfer through these necessary drilled holes, reducing the energy usage in said building, helping our Countries energy conservation program.

12 Claims, 11 Drawing Figures

BUSHING, FORMED COMPRESSIBLE INSULATION FOR INSULATING AIR SPACE CREATED BY HOLES

BACKGROUND OF THE INVENTION

This invention relates to wood frame structural components as used in framing up a building, such as a dwelling, said components must be drilled many places for installing plumbing piping and electrical wiring. This invention comprises a bushing, of formed compressible expandable thermal insulation for said holes.

Tests have shown up to 20% of the infiltration of a home is caused through wall outlets, this infiltration must come through the drilled holes for the plumbing piping and electrical wiring.

This invention will place thermal insulation through said holes, plus stop infiltration.

This invention will provide a new use for thermal insulation material and create an easy standard way to insulate said holes.

This invention will stop the use of sealers which are costly, plus they are very messy and hard to work with.

This invention will reduce labor cost, because the bushing can be placed in the hole as the skilled tradesman drills said holes.

Presently, most builders do nothing because the holes are drilled by two separate tradesman and they cannot afford $15.00 to $20.00 per hour to have the respective tradesman go back through the house and pump or squeeze sealers into said holes, created for the plumbing piping or electrical wiring, this labor would be eliminated if the tradesman would simply insert a bushing of formed compressible expandable thermal insulation into said holes as they drill them, or snap on a bushing as they run the plumbing piping (article) or electrical wiring (article) through said drilled holes, either pressing or pushing a bushing into the hole or just pushing a bushing up tight to the framing components which would close off the opening created between said articles and the periphery wall of said holes, thusly, helping our countries energy conservation program.

Specifically this invention is related to placing a bushing of formed, compressible expandable thermal insulation into a hole filling the space created because said hole is usually much larger then the articles being installed in said holes, thusly conserving energy, but a bonus would be to stop insects or the like from entering through said holes.

DETAILED DESCRIPTION OF THE INVENTION

Figure 1:
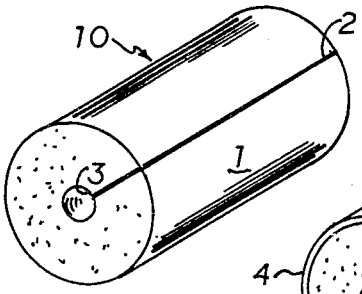
FIG. 1, is a perspective view of a bushing formed of insulation showing an expansion hole with a slit through said bushing.

Reference is now made in great detail to the FIGS. 1 through 11 of the drawings which are illustrative only and wherein like elements are designated by the same reference numerals.

FIG. 1, is a perspective view of an energy conservation device, manufactured from formed, compressible expandable thermal insulation 1, such as fiber glass, foamed rubber, or plastic foam.

This device is constructed to be placed in drilled holes for installing plumbing pipes 70 and electrical wiring 80 in wood frame buildings or even buildings where metal structural components are used and holes are drilled through said components and plumbing piping (articles) 70 and electrical wiring (articles) 80 are installed in said building structural framing.

This invention for the sake of simplicity will be referred to as a bushing throughout this detailed description.

Figure 11:
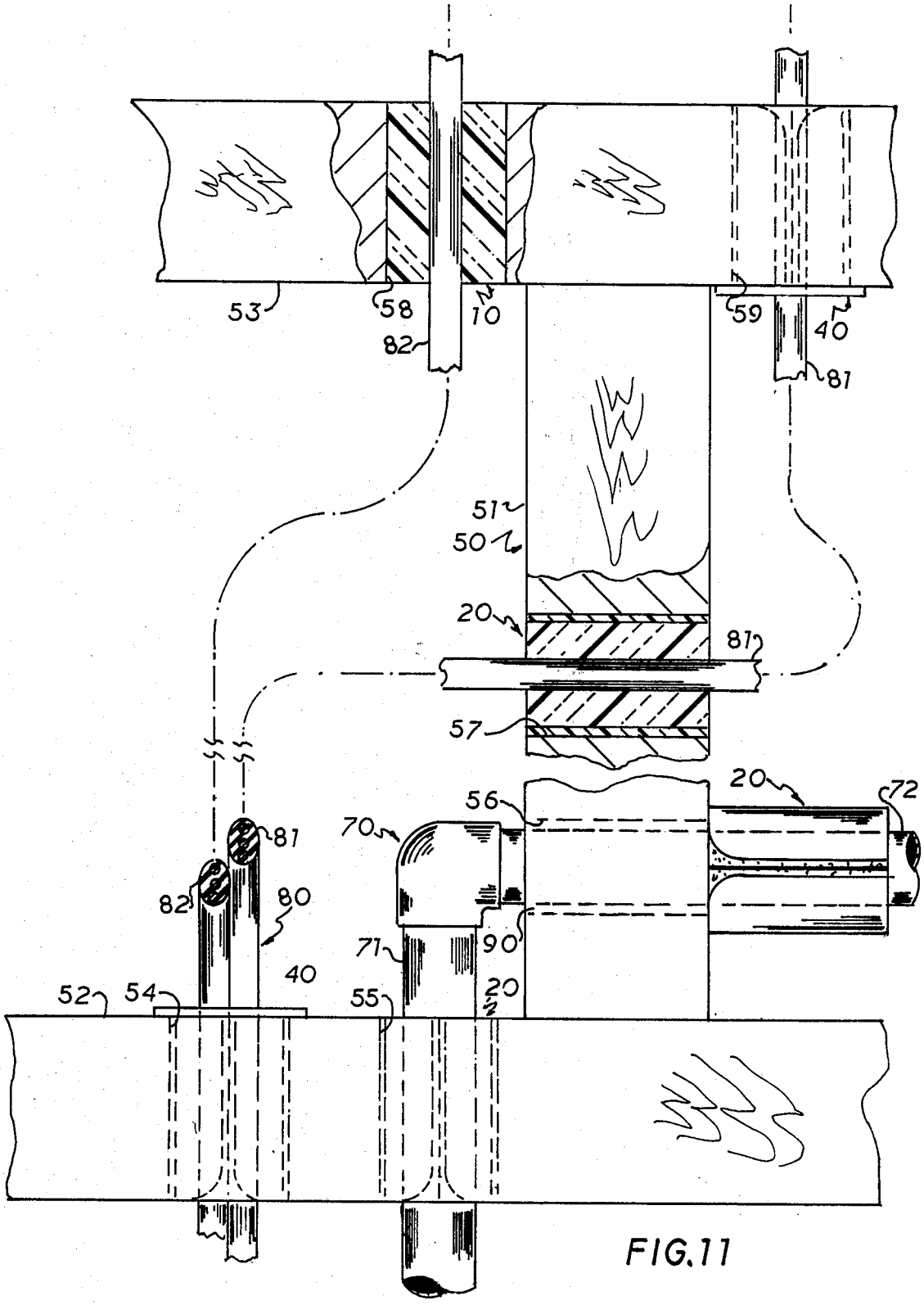
FIG. 11, shows building components for rough framing a building, such as a dwelling, with the components drilled, with plumbing piping and electrical wiring installed therein, showing 3 ways to construct and install said bushings.

Bushing 10 is formed of compressible expandable thermal insulation 1 which is of a cylindrical design with a slit 2 running full length of said bushing 10 and penetrating to the longitudinal center line or to the expansion hole 3, slit 2 serves two purposes:

A. allows said bushing 10 to be placed or spapped on said articles 70 and 80 so the bushing 10 can be pushed into said building framing component and closing said hole as shown in FIG. 11;

and

B. allows bushing 10 to compress inwardly when manual hand pressure is applied to said bushing 10 to facilitate placing or installing said bushing 10 into a hole.

Slit 2 will suffice alone but could be used in conjunction with an expansion hole 3 which would expand outwardly as said articles 70 and 80 are pushed or pulled through said holes.

Figure 1A:
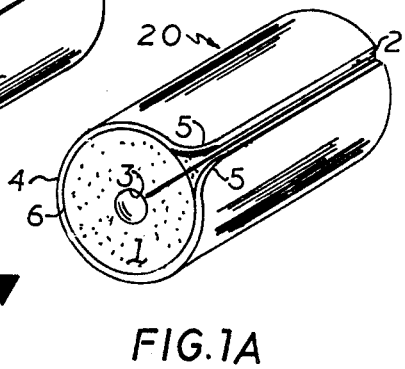
FIG. 1A, is the same as FIG. 1 except the bushing has a flexible cover with a slit having radii on both sides of the slit, on one end only.

FIG. 1A shows a perspective view of the bushing 20 which is identical to bushing 10, FIG. 1, except an outer protective flexible surface layer 4 has been added, surface layer 4 can be manufactured from the same material as insulation 1, but more rigid than said insulation 1 or manufactured from a paper product, plastic product or even metal, with a means 6 to adhere surface layer 4 to said insulation 1. Surface layer 4 has a slit 2 running full length of said surface layer 4 which coincides with slit 2 in said insulation 1, radii 5 has been added to slit 2 at the lower end of both edges of slit 2.

Surface layer 4 serves several purposes:

A. protection for insulation 1;

B. add rigidity to the bushing 20;

C. provides radii 5, (radii 5 are placed against the articles 70 and/or 80 and manual, hand pressure is applied to said bushing 20, bushing 20 will smap on or around articles 70 and 80); and D. surface layer 4 will compress inwardly closing said slit 2 and allowing said bushing 20 to become smaller in diameter, facilitating placing said bushing 20, 30 and/or 40 in said holes and will expand outwardly to apply pressure to said hole periphery wall to prevent the bushing from falling out of said holes.

Figure 2:
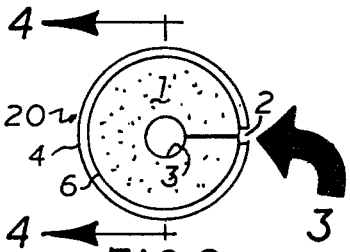
FIG. 2, is an end view of FIG. 1A with a section bar for FIG. 4.
Figure 3:
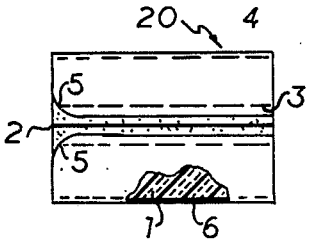
FIG. 3, is a side view of FIG. 1A.
Figure 4:
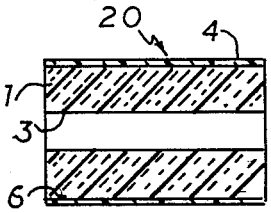
FIG. 4, is a section taken on line 4—4 of FIG. 2.

To further describe said bushing 20, FIG. 2, FIG. 3, and FIG. 4 are provided which are self explanatory.

Figure 5:
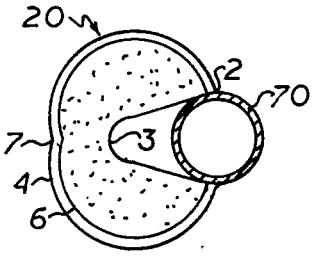
FIG. 5, is a typical end view of a bushing and is a section through a typical pipe showing how the bushing slit will allow said bushing to be spread and snapped around the plumbing piping or electrical wiring.

FIG. 5 demonstrates how said bushing can be spread and placed or snapped around said articles 70 and 80, hinging at point 7 and snapping back to said bushings 20 original state.

Figure 6:
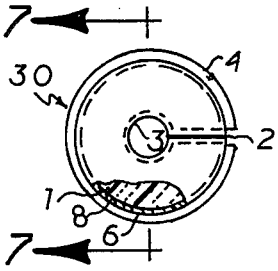
FIG. 6, is an end view of FIG. 1A, with an envelope completely enveloping said insulation.
Figure 7:
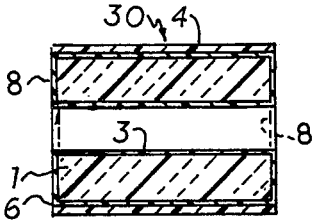
FIG. 7, is a section taken on line 7—7 of FIG. 6.

FIG. 6 shows an end view of a bushing 30 identical to bushing 10 and 20 except an envelope 8 has been added to protect said insulation 1 and means 6 is provided to adhere said envelope 8 to surface layer 4. The envelope completely encompasses said insulation 1 and can be made from any material that is compressible and will return to its original free state, such as a rubber product or plastic product, furthermore it can be liquid proof, moisture proof and fire resistant, envelope 8 also allows insulation 1 of the type such as glass fiber to be used or any other material that is fibrous, powdery, jelly like, or even liquids can be used as insulation 1, thereby closing the space 90 as shown in FIG. 11 which is created by article 70 when installed in hole 56.

Figure 8:
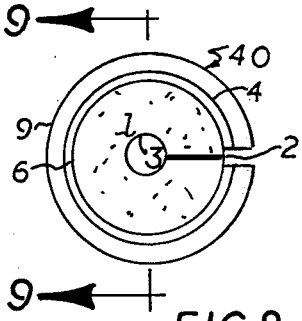
FIG. 8, is an end view of FIG. 10, showing FIG. 1A with a right angle flange.
Figure 9:
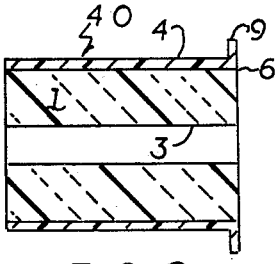
FIG. 9, shows a section on line 9—9 as shown in FIG. 8.
Figure 10:
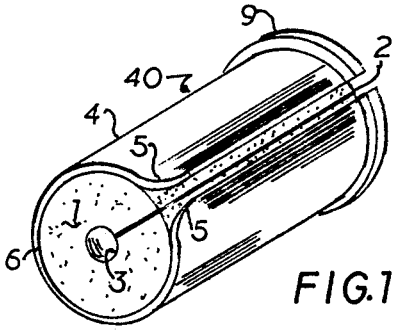
FIG. 10, is a perspective view of FIG. 1A with a right angle flange on one end of said bushing.

FIG. 8 is an end view of bushing 40 which is identical to bushing 20 except a right angle flange 9 has been added to one end of surface layer 4, flange 9 provides a method to prevent bushing 40 from being pulled or pushed out of said holes when articles 70 or 80 are being installed, this method comprises placing all the flanges in one direction and the articles are pushed and started at the flange 9 end of said bushing 40, of course the flange 9 can also be used for metal fasteners and does not limit the possibility of using adhesives to hold said bushings in said holes.

FIG. 11 is a typical wall 50 with framing components, comprising a sole plate 52, wall stud 51, and a single top plate 53. Note: stud 51 has been cut away to show the bushing 20 and article 81 installed in said bushing 20, below said cut away is an article 72 running through the hole 56 which creates space 90 which is closed off by bushing 20, below, the sole plate 52 shows a type bushing 40 in the hole 54 and a type bushing 20 in the hole 55, above at the top of the page the single top plate 53 is shown cut-a-way at the bushing 10 showing hole 58 and article 88 is installed therein, to the right of the wall stud 51 another example of how the bushing 40 can be used, installed in a hole 59, FIG. 11 demonstrates the purpose of the energy saving device as referred to as a bushing, it demonstrates three designs of said bushing and two methods of using said bushing for closing off space 90 and preventing infiltration and heat transfer through said space 90, which is a new use for thermal insulation materials which provides a new method for sealing said space and eliminates use of unsafe materials such as messy sealers, etc.

I claim:

1. An improved wood building structure such as a dwelling, said building structure having outer periphery walls comprised of wood structural wall components, further comprising electrical and plumbing articles being installed through drilled holes in said components, wherein the improvement comprises:

a one piece bushing formed of compressible expandable thermal insulation being installed around said articles and therebetween said inner circumference wall of said drilled holes, defining a thermally insulated air space; and reducing infiltration and heat transfer through said air space, conserving energy now used to heat or cool said building, said one piece bushing being cylindrically formed of compressible expandable thermal insulation with a slit running the full length of said bushing; and penetrating to the longitudinal center line thereof, said bushing comprising an expansion hole formed on the longitudinal center line; and running the full length of said one piece bushing, said bushing comprising an outer protective flexible surface layer with a slit running full length of said surface layer, coinciding with said slit in said compressible expandable thermal insulation one piece bushing.

2. A bushing as recited in claim 1, comprising:

means to adhere said inner means insulation means to said outer protective, flexible, surface layer.

3. A bushing as recited in claim 2; comprising:

radii on both edges on at least one end of said slit in said outer protective, flexible surface layer.

4. An improved wood building structure, such as a dwelling, said building structure having outer periphery walls comprised of wood structural wall components further comprising electrical and plumbing articles being installed through drilled holes in said components, wherein the improvement comprises:

a one piece bushing formed of compressible expandable thermal insulation being installed around said articles therebetween said inner circumference wall of said drilled hole, defining, a thermally insulated air space; and reducing infiltration and heat transfer through said space, conserving energy now used to heat or cool said building, said one piece bushing being cylindircally formed of compressible expandable thermal insulation a slit running the full length of said bushing; and penetrating to the longitudinal center line thereof, said bushing comprising an expansion hole formed on the longitudinal center line; and running the full length of said one piece bushing, said one piece bushing formed of thermal insulation comprising a protective enveloping means to cover said thermal insulation.

5. A bushing as recited in claim 4, comprising:

an outer protective, flexible surface layer completely encompassing said envelope thermal insulation; and a means to adhere said enveloping means to said protective flexible surface layer.

6. A one piece bushing as recited in claim 5, comprising:

a formed flange at one end of said bushing; and at right angles to said bushing longitudinal center line.

7. An improved thermal insulation one piece bushing means of the type as recited in claim 25, comprised of an enveloping means completely encompassing said thermal insulation means, wherein the improvement comprises:

an enveloping means which is fire resistant; and will protect the thermal insulation encompassed therein.

8. An improved thermal insulation bushing means of the type as recited in claim 7, comprised of an enveloping means completely encompassing a thermal insulation means, wherein the improvement comprises:

said insulation means being a glass fiber insulation material.

9. An improved thermal insulation bushing means of the type as recited in claim 7, comprised of an enveloping means completely encompassing a thermal insulation means, wherein thwe improvement comprises:

said insulation means being a resilient, fibrous thermal insulation material.

10. An improved thermal insulation bushing of the type as recited in in claim 7, comprised of an enveloping means completely encompassing a thermal insulation means, wherein the improvement comprises:

said insulation means being a resilient, powdery thermal insulation material.

11. An improved thermal insulation bushing of the type as recited in claim 7, comprised of an enveloping means completely encompassing a thermal insulation means, wherein the improvement comprises:

said insulation means being a jelly compound having thermal insulation properties, substantially filling said enveloping means.

12. An improved thermal insulation bushing of the type as recited in claim 7, comprised of an enveloping means completely encompassing a thermal insulation means, wherein the improvement comprises:

said insulation means being a liquid compound having thermal insulation properties, substantially filling said enveloping means.

* * * * *

UNITED STATES PATENT AND TRADEMARK OFFICE

CERTIFICATE OF CORRECTION

PATENT NO. : 4,337,603

DATED : July 6,1982

INVENTOR(S) : James D. Davidson

It is certified that error appears in the above-identified patent and that said Letters Patent is hereby corrected as shown below:

Col. 4. claim 7, line 2; change "25"
to ----5----.

Signed and Sealed this

Sixteenth Day of November 1982

[SEAL]

*Attest:*

GERALD J. MOSSINGHOFF

*Attesting Officer*

*Commissioner of Patents and Trademarks*